US006076570A

United States Patent [19]

Byrne

[11] Patent Number: 6,076,570

[45] Date of Patent: Jun. 20, 2000

[54] CLOSURE CONTAINING A FLUID FOR MIXTURE WITH A BEVERAGE

[76] Inventor: Paul Anthony Byrne, 222 Titwood Road, Pollokshields, Glasgow G41 4BO, United Kingdom

[21] Appl. No.: 08/981,323

[22] PCT Filed: Jun. 12, 1996

[86] PCT No.: PCT/GB96/01391

§ 371 Date: Dec. 15, 1997

§ 102(e) Date: Dec. 15, 1997

[87] PCT Pub. No.: WO97/00213

PCT Pub. Date: Jan. 3, 1997

[30] Foreign Application Priority Data

| | | | |
|---|---|---|---|
| Jun. 14, 1995 | [GB] | United Kingdom | 9512102 |
| Aug. 1, 1995 | [GB] | United Kingdom | 9515722 |
| May 9, 1996 | [GB] | United Kingdom | 9609648 |

[51] Int. Cl.[7] ..... B65B 1/04

[52] U.S. Cl. ..... 141/379; 141/64; 141/63; 141/21; 141/22; 141/100; 141/102; 141/104; 220/202; 220/203.01; 220/203.05; 220/203.06

[58] Field of Search ..... 141/64, 63, 21, 141/22, 100, 102, 104, 379; 220/202, 203.01, 203.05, 203.06

[56] References Cited

U.S. PATENT DOCUMENTS

| | | | |
|---|---|---|---|
| 4,934,543 | 6/1990 | Schmidt | 215/228 |
| 5,348,060 | 9/1994 | Futagawa et al. | 141/100 |

*Primary Examiner*—Steven O. Douglas
*Attorney, Agent, or Firm*—Woodard, Emhardt, Naughton Moriarty & McNett

[57] ABSTRACT

A closure including an integral chamber for storing a fluid separately from a beverage stored in a container to which the closure is attached is provided with a pre-formed court or aperture and a valve, the valve being operable to an open position when intended to allow release of the fluid in the chamber to mix with beverage in the container, the apparatus being particularly suitable for carbonating or recarbonating beverages.

14 Claims, 6 Drawing Sheets

CLOSURE CONTAINING A FLUID FOR MIXTURE WITH A BEVERAGE

This invention involves apparatus and method relating to beverages and finds a particular, although not exclusive, application in the carbonating or recarbonating of beverages in a domestic environment where the beverage is contained in a bottle or like container. The beverage may be of an intoxicating or alcoholic type, such as sparkling wine, or may be of a type referred to commonly as a "soft drink", being non-alcoholic. Indeed the invention herein finds a primary, but not exclusive application in relation to any drink where there may be benefit in it being carbonated or further carbonated prior to its complete consumption.

It is common for such drinks to be sold or supplied in containers, for example PET bottles, of a size which may allow for their consumption over a relatively extended period and on several different occasions. A problem encountered with such drinks, however, is that once the seal or closure of the bottle has been opened the level of "fizz" is reduced and the drinks can become "flat". This lessens the appeal of the drink and can frequently lead to wastage.

It is appreciated in this invention that a cause of this undesirable decarbonating or flattening of such beverages is due to the escape of gas from the liquid and, subsequently, from the bottle. When the beverage is adequately carbonated the pressure in the bottle is greater than atmospheric pressure, and thus gas naturally escapes when the bottle is opened and reopened over a number of occasions. Also, once the closure on a bottle has been opened for a first time the integrity of the seal is diminished and not usually fully recovered upon reclosing the bottle top.

In the past it has been known to attempt to provide apparatus for mitigating the escape of carbon dioxide from carbonated beverages using an air pump which may be integral or attachable to a bottle closure. Such apparatus typically provides a valve in the bottle closure which allows for the intake of pumped or compressed air. The intention with such devices is that by repressurising the internal volume of a beverage containing bottle, gas dissolved in the liquid is caused to remain so dissolved. Examples of such devices are taught in U.S. Pat. No. 5,294,010 and U.S. Pat. No. 4,763,802. These and similar devices have been found non practical and cumbersome. Further, they are not adapted to increase the carbonation of a beverage, but rather merely slow the process of the beverage decarbonating.

Further disadvantages of devices adapted to pressurise the gap or space between the beverage and the top of the bottle with air include that they are expensive to manufacture and they encourage the contact of air with the beverage which may diminish product life, particularly in respect of wines or fruit drinks.

Another manner by which some have attempted to overcome this recognised problem involves the provision of an adaptor or other connecting device intended to enable, via a sealed fluid channel, the passing of carbon dioxide from a pressure cylinder containing such gas into the beverage containing bottle. Examples of such connectors may be examined in U.S. Pat. No. 4,899,896 and British Patent Application GB 2 175 681. Again, however, such designs have not proven satisfactory as, in use, adaptors can be lost or inconvenient, and the process of "setting up" the equipment both tedious and awkward.

An object of the present invention is to provide simple, convenient and practical apparatus in the form of a container closure for enabling a drink to be carbonated or recarbonated; the apparatus additionally or alternatively being appropriate for the mixing of other fluids, whether gaseous or liquid, in a beverage.

It is also herein observed that past attempts to provide apparatus comprising a means for storing a fluid in a container closure and separately from a second fluid in the container has required, in use, the rupturing of part of the closure to release the first fluid and enable the two fluids to be mixed together. A disadvantage associated with the partial rupturing of the closure, usually at a membrane or the like, is that, as the exact nature or shape of the rupture is unpredictable, the flow of the fluid from the closure is not easily controlled. This is particularly disadvantageous in relation to the release of a pressurised gas intended to be dissolved in a beverage contained in the container.

It is also recognised herein that the use of a membrane which is adapted to rupture with relative ease when required, restricts the ability of the chamber to store fluid, and potentially a gas, at high pressures.

Yet further, such membranes are generally ruptured by being brought forcibly into contact with a sharp edge or blade; this feature being undesirable and potentially dangerous in view of the unfortunate tendency to discard disposable closures on pavements and in other accessible areas.

It is therefore a further object of the present invention to provide a suitable release means for releasing a fluid from a container closure into the container when desired. A yet further object of the invention is to cause the fluid held in the chamber to be released into direct contact with the beverage.

According to the present invention there is provided a closure for use in relation to a beverage container, the closure comprising sealing means for sealingly engaging the container, an integral chamber formed within or as part of the closure for sealingly containing a fluid for mixture with the beverage, and a release means for releasing the fluid from the chamber into the attached container.

Where it is intended to carbonate or recarbonate a beverage the chamber advantageously is constructed as a pressure vessel to safely house a carbonating fluid pressurised, for example, in excess of twenty atmospheres. (This is not to say that the normal working pressure of the fluid, even in such applications, need be this high; but rather to allow for extreme conditions resulting from temperature variations, impact loads and so on.)

Preferably the release means includes one or more apertures or ports in a wall of the chamber, the aperture or port being associated with a valve such that when the closure is engaged with the container and the valve is open the fluid in the chamber may physically communicate with the beverage and when the valve is closed the fluid is retained in the chamber.

Preferably the sealing means may enable the closure to be repeatedly and sealingly attached to and removed from the container without essentially operating the valve.

This has the considerable advantage of enabling the mixture of the fluid with the beverage at a time subsequent to the initial opening of the container.

Preferably the aperture or port is preformed in the chamber wall. This allows the aperture to be shaped under manufacturing conditions to a design which optimises the flow of the fluid into the container for mixing or dispersion purposes.

It has been found that a nozzle designed to release a gaseous fluid into the beverage in the form of a fine spray of bubbles optimises the absorption of the gas by the beverages. Such a nozzle may be formed into or associated with the aperture.

Alternatively, the aperture may be formed, in use, by puncturing or rupturing the chamber wall. The chamber may have an inner compartment and an outer compartment, the inner compartment including a rupturable membrane and the outer compartment having a preformed aperture in its wall.

The valve may be adapted to reseal the aperture after having been opened. Such a feature is advantageous where it is beneficial to ensure that any remaining fluid or received beverage does not escape or drip from the closure when the closure is removed from the container. Beneficially it may be that the valve is operable to an open position only when the closure is attached to the container and is necessarily returned to a closed position upon or prior to being removed from the container.

The valve may include a valve seal which is retained in a sealing relationship with the aperture when the valve is closed by a retaining means. The retaining means may include a valve body, possibly in the form of an arm or sleeve of the like, acting upon the valve seal to retain it in position. Apart from the retaining means other influences, including the pressure of the fluid in the chamber and the gravitational pull acting on the valve, may act to resist movement of the valve seal away from the aperture.

The retaining means may be released by the tightening or clockwise rotation beyond a predetermined level of the closure or part of the closure on or relative to the container.

Alternatively the retaining means may comprise fluid pressure acting on the valve seal, the retaining means being releasable by creating a reversed pressure differential or gradient across the valve seal which encourages the valve seal to move in a direction away from the aperture.

Advantageously the valve may be operable to an open position only when the closure is in an inverted orientation. This is advantageous where the fluid is at least partly in a gaseous state and it is desirable to release the fluid directly into the beverage rather than into a space within the container occupied by air between the closure and the beverage. It is considered that conduits or the like leading from the chamber, through the space between the closure and the beverage, when upright, and into the beverage are less desirable, particularly when the conduits require to be removed from the container or bottle in order for the beverage to be accessed or poured.

Preferably the closure is further provided or inherent with valve disenabling means for preventing the inadvertent opening of the valve. The disenabling means most suitably provides a physical obstruction to releasing the retaining means.

The disenabling means may be in the form of an insert located in the closure which may be removed or disengaged, when intended, at the discretion of the user. Alternatively the disenabling means may be one or more associated lugs or catches which require to be fractured or pressed past in order to open the valve. Alternatively, the disenabling means may be a cover denying access to the retaining means during the usual opening or closing operation of the closure relative to the container.

Preferably the fluid comprises gas of a type which is soluble in the beverage and when so dissolved has the effect of increasing the carbonation of the beverage. The gas may be carbon dioxide. It may also include nitrogen. It may include a refrigerant, such as isobutane or propane.

Alternatively the fluid may include a flavouring. It may be a carbonating gas mixed with or dissolved in a liquid flavouring, for example in a syrup.

According to a further aspect of the invention there is provided a method of releasing a fluid stored in a closure into a container, the method including the steps of:

1) sealingly engaging the closure relative to the container; and 2) releasing a retaining means for retaining a valve in a closed position relative to an aperture or port in the closure; the aperture or port providing an escape path for the fluid from the closure.

The method may also include the step of inverting the container and engaged closure, either before or after step 2 above.

The method may also include the step of removing or rendering inoperable a disenabling means for disenabling the operation of the valve associated with the closure either before or after step 1 above, but before step 2.

Various embodiments of the invention will now be described, by way of example only, with reference to the accompanying figures in which:

FIG. 1 is a pictorial illustration of a closure attached to a plastics soft drink bottle;

FIGS. 2*a* and 2*b* are sectional elevations of preferred embodiments of a closure in accordance with the invention;

Figure 1:
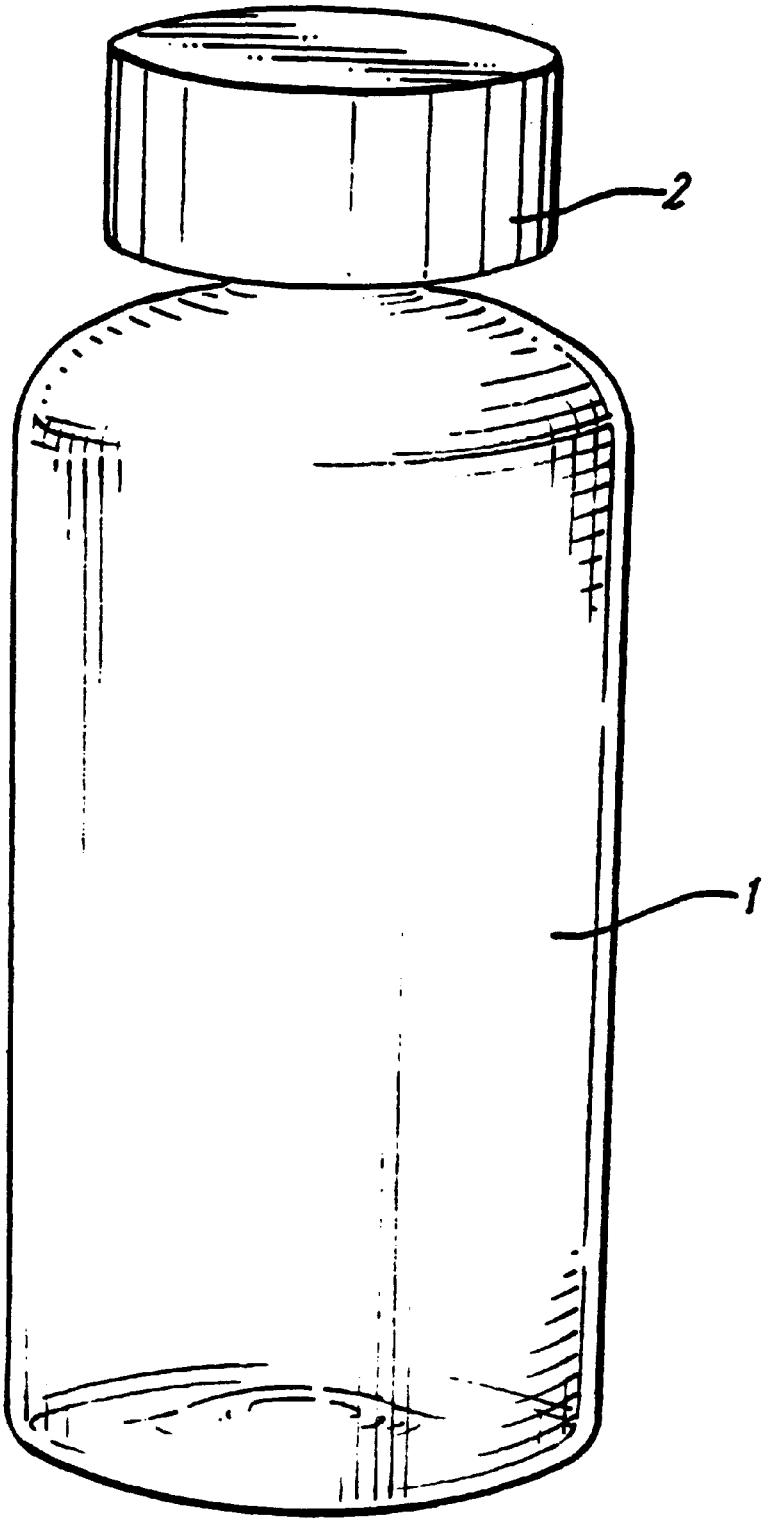

Referring firstly to FIG. 1 there is shown a bottle 1 to which there is sealingly attached a closure 2. The closure is larger than conventional or traditional bottle closures, but need not be so large as to be difficult to hold or grip. In fact, its size may be one which arguably optimises a user's ability to tightly grip the closure, while also providing a large suitable surface for bearing promotional or descriptive printed information.

Figure 2A:
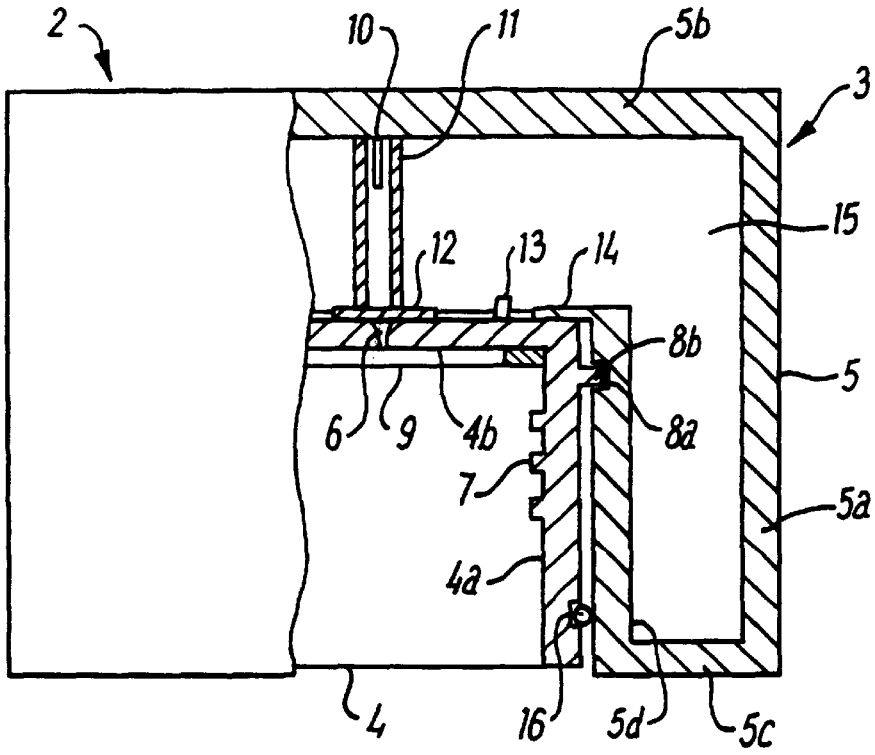
Figure 2B:
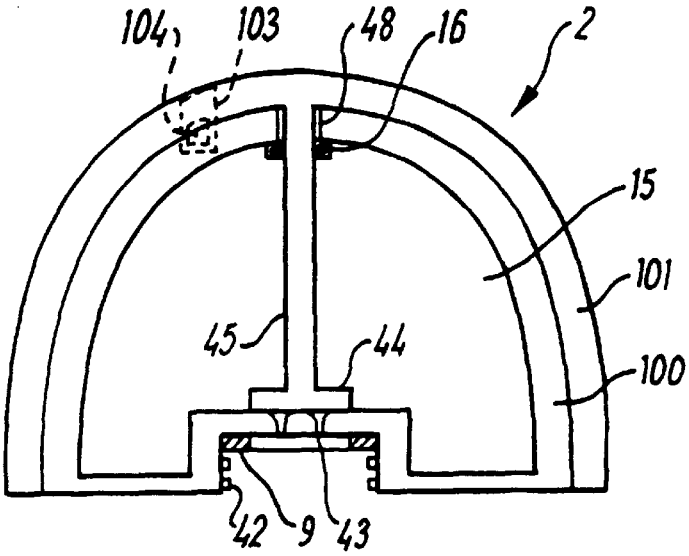

Preferred embodiments of a closure are illustrated in FIGS. 2*a* and 2*b*. In FIG. 2*a* the closure 200 comprises a housing 3 consisting of at least two separate components, namely an inner member 4 and an outer shell 5. If desirable, these members may be formed of more than one part, depending on manufacturing methods and materials employed. The housing defines an internal chamber 15 in which is stored a pressurised fluid, such as carbon dioxide. By way of example, the chamber 15 may be twenty cubic centimeters and contain two grams of $CO_2$.

The inner member 4 is substantially in the form of a cylinder 4*a* closed at one end by an upper cap 4*b*. Located in the upper cap 4*b* is a passage or aperture 6.

The internal face of the cylinder 4*a* is provided with a means for sealingly engaging a container, which here, by way of example, is an internal thread 7 corresponding to an external thread on a bottle or other container. Notably, the thread 7 is a right hand thread. An annular seal 9 is provided as shown.

The outer shell 5 also has an outer cylindrical wall 5*a*, an upper plate 5*b*, an annular base 5*c* and an inner cylindrical wall 5*d*. The inner cylindrical wall 5*d* is provided with an internal thread 8*a* which corresponds to an external thread 8*b* formed integrally with the outside surface of the cylindrical wall 4*a* of the inner member 4. Notably the thread 8 is a left hand thread.

A guide pin 10 extends downwardly from the centre of the upper plate 5*b*. An O-ring 16 is also provided, as shown, to seal the chamber 15.

A valve for closing the aperture 6 comprises a retaining means in the form of a sleeve 11, and a valve seal 12 attached to or integral with the lower end of the sleeve 11. The sleeve 11 is located over the guide pin 10, such that the valve seal 12 is positioned over the aperture 6.

The embodiment of closure shown in FIG. 2*a* is also provided with a valve disenabling means. By this reference is made to the small lug 13 protruding from the top face of the upper cap 4*b,* and the arm 14 which projects inwardly at one point on the upper edge of the wall 5*d.*

In use the closure 200 may be attached to the neck of a container by conventionally screwing the closure in a clockwise direction. By this action both the outer shell 5 and the inner member 4 is tightly and sealingly engaged on the neck of the container. The further clockwise rotation of the outer shell 5 will firstly cause the arm 14 to fracture the lug 13 and thereafter cause the outer shell 5 to rise upwardly relative to the inner member 4. The upward movement results from the left hand thread 8.

As the outer shell 5 so rises the upper plate 5*b* and guide pin 10 lift off the top rim of the sleeve 11, providing a gap between the top rim of the sleeve 11 and the lower face of the upper plate 5*b.* The pressure of the fluid in the chamber 15, together with the weight of the sleeve 11 and valve seal 12 hold the valve in a sealing relationship over the aperture 6 until the closure and container is inverted. When inverted the sleeve 11 and valve seal 6 fall back down the guide pin 10 onto the upper plate 5*b* allowing the release of fluid through the aperture 6.

In order to remove the closure the outer shell 5 is rotated in a conventional anti-clockwise direction which firstly causes it to return back downwardly relative to the inner member 4. This action clamps the sleeve 11 and valve seal 12 back over the aperture 6 re-sealing the aperture 6. The further anti-clockwise rotation of the outer shell 5 causes the inner member 4 to also rotate in an anti-clockwise direction, which serves to loosen the closure from the neck of the container.

FIG. 2*b* illustrates an embodiment which works substantially on the same principle as the embodiment of FIG. 2*a,* although in preferred form. The closure 201 comprises a chamber 15 provided by a domed internal member 100. Fitted snugly over the internal member 100 is a cover member 101. The internal member 100 is provided with a engaging means 42 for engaging a container. An annular seal 9 is provided in juxtaposition with the sealing means 42 to prevent the inadvertent escape of beverage from the container through the engaging means 42. In the lower wall of the inner member 100 is provided two preformed apertures 43 shaped to provide the release of fluid contained in the chamber 15 in the form of a fine spray of bubbles or the like.

A rod 45 extends from the cover 101 and is threaded at 48 with a left hand thread where it engages a corresponding thread in the inner member 100. An O ring 16 provides a seal at the thread 48. At the bottom of the rod 45 is a valve seal 44 which, in use, seals the apertures of 43.

A channel 103 is provided in both the cover 101 and inner member 100, there being further provided a key 104 located in the channel 103 which, when the closure 2 is in a normal upright orientation, nests at the bottom of the channel 103 and, by reason of its size, prohibits the rotation of the cover 101 relative to the inner member 100. However, when the closure 201 is inverted the key 104 drops down the inverted channel 103 and nests in the channel 103 such that it is contained wholly within the cover 101, thereby allowing rotation of the cover 101 relative to the inner member 100.

In use, having regard to the embodiment of FIG. 2*b,* the closure 201 may contain carbon dioxide in addition, if desired, to any other fluid and may be sealingly engaged to a container via the sealing engagement means 42. The engagement means 42 may comprise a right hand thread to allow for attachment of the closure to the container in a standard right hand screw on manner. To screw the closure 201 onto the container the closure 201 may be gripped by the outer cover 101 as rotation of the cover 101 relative to the inner member 100 is prohibited by the key 104. When it is then desired to release the fluid contained in the chamber 15 into the container, the container and closure 201 is inverted causing the key 104 to drop down the inverted channel 103 thereby being contained wholly within the cover 101. Further right hand rotation of the cover 101 then causes the cover 101 to be lifted away from the inner member 100 via the left hand thread 48. This in turn lifts the rod 45 and valve seal 44 exposing the apertures 43 to the fluid, allowing for the release of same. As the container is inverted the fluid is released directly into contact with the beverage contained in the container.

Thus, the valve is only operable when the container and closure are sealingly engaged and inverted, and advantageously, the key 104 is allowed to drop under the influence of gravity without the resistance of high pressure fluid, thereby being distinguished from other embodiments where the valve seal drops when inverted, under gravity, against the pressure of the fluid.

Figure 3:
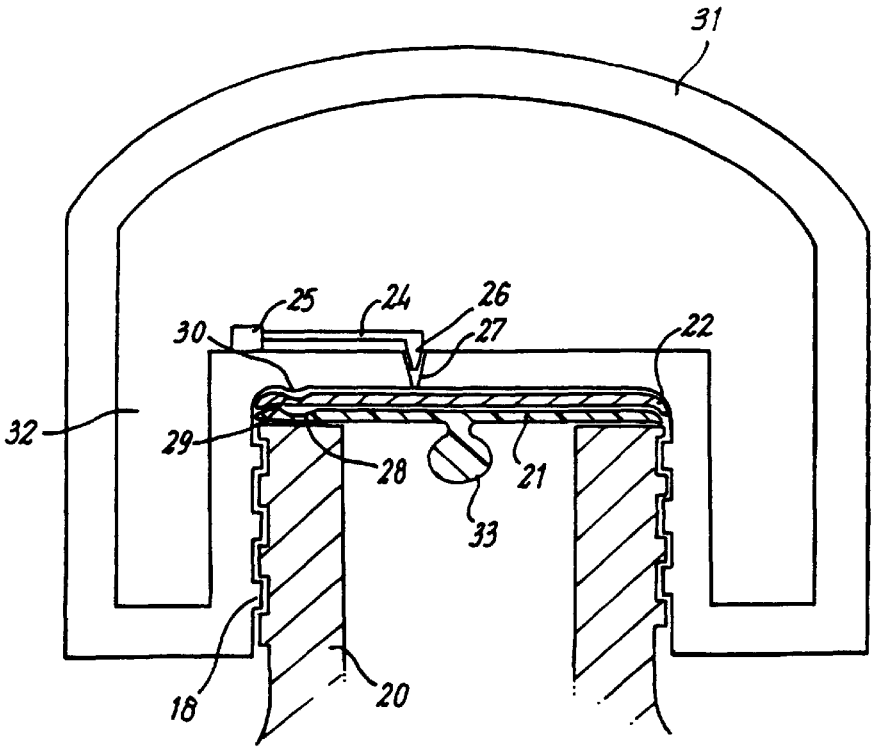
FIGS. 3, 4 and 6 illustrate further embodiments of a closure.

In FIG. 3 there is shown an alternative embodiment of a closure. The closure comprises an outer shell 31 substantially of a domed cylindrical form, but with a receptive threaded bore 18 on its underside to allow for sealing engagement with a threaded bottle neck 20 or the like. The shell 31 defines a chamber 32 in which may be located a fluid, stored under pressure and intended for mixing with the beverage stored in the bottle.

An insert 21, preferably made of a resilient and pliable rubber or plastics material, acts as a disenabling means and is located between an annular seal 22 and the rim of the bottle neck 20. A small handle 33 is formed on the insert 21.

The shell 31, at that part of it which sits over the area within the neck of the bottle, has one or more small apertures 27. The apertures 27 are associated with a valve comprising a valve seal 26 and a rigid arm 24 anchored at 25 to the shell 31. The anchor 25 is beneficially located marginally outside the circumference of the bottle neck 20.

A small hard semi spherical knob 30 is formed integrally on the underside of the shell 31 and directly below the arm 24. The seal 22 is provided with a dimple 29 to receive the knob 30. A similar dimple 28 is provided on the upper side of the insert 21.

The effect of the dimple 28 in the insert 21 is to prevent the rim of the bottle neck 20 from bearing forcibly on the seal 22 at that point on the seal 22 directly below the knob 30, regardless of how tight the closure is screwed onto the bottle.

When it is desired to mix the fluid in the chamber 32 with the beverage in the bottle or like container, the closure is first removed from the bottle and the insert 21 is pulled out using the handle 33. The insert 21 may be discarded, or may be used as a token, collectors item or for any promotional activity. With the absence of the insert 21, the closure may then be screwed onto the bottle neck 20 and eventually, when the closure is on tight, the rim of the bottle neck 20 will bear upon the seal 22. As the seal 22 is relatively thin below the knob 30, further tightening of the closure will push the knob 30 upward, causing the shell 31 to buckle slightly above the knob 30. The buckling of the shell 31 in this vicinity, in turn, lifts the rigid arm 24. The anchor 25 may be deformed or ruptured by this, although the combination of the weight of the arm 24, valve seal 26 and pressure differential across the valve seal 26 and aperture 27 act to maintain the valve seal 26 in its sealing relationship with the aperture 27. Where this is difficult to achieve, a further arm or clip (not shown) may be employed to restrain the arm 24 and valve seal 26 in a position which maintains the valve in a closed capacity.

However, upon the inversion of the bottle, the weight of the valve and any additional restraining means pulls the valve seal 26 away from the aperture 27 allowing for the fluid in the chamber 32 to pass through the aperture 27 and mix with the beverage in the bottle.

Figure 4:
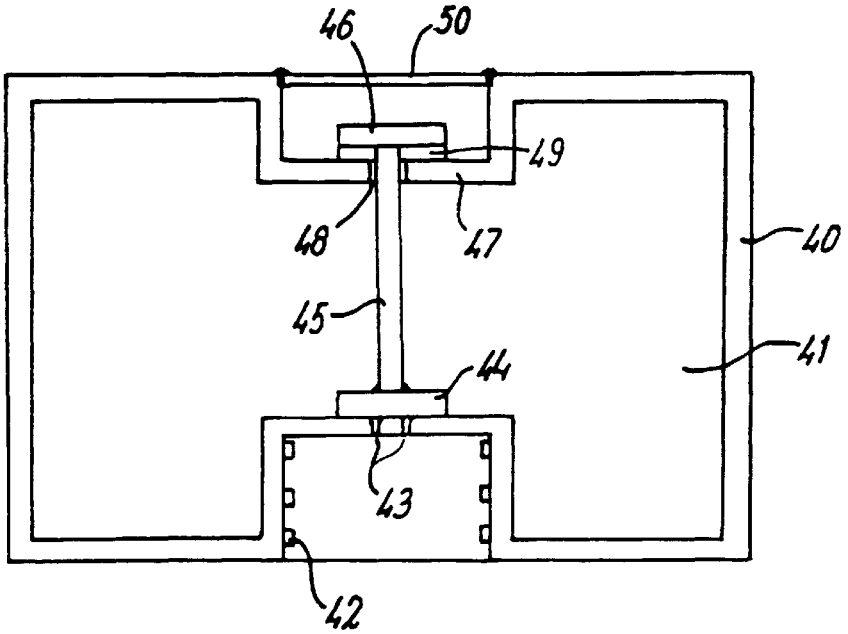

A further embodiment of a closure shown in FIG. 4 has a housing 40 defining a chamber 41. As before, the housing is provided with a thread 42 for sealing engagement with a beverage container. It should be appreciated that any suitable attachment means may be used for this purpose.

Two pre-formed apertures 43 are provided in the housing 40 directly over the neck of the container (not shown). The apertures 43 are sealed by a valve seal 44. The valve seal 44 is part of a valve which also includes a restraining means in the form of a threaded bolt 45 with head 46. Notably the restraining means presses downwardly on the valve seal 44, but is not attached to the valve seal 44.

The bolt head 46 nests in a seat 47 provided at the top of the closure. Tapped into the seat 47 is a thread 48 which receives a corresponding thread on the bolt 45. A seal 49 is positioned between the head 46 and the seat 47 in the housing 40. In use, rotating the bolt 45 by turning the head 46 causes the restraining means to lift off the valve seal 44. However while the closure is upright the valve seal, being suitably weighted, remains over the apertures 43 under the influence of gravity. Only when the closure is inverted is the valve seal 44 caused to fall away from the apertures 43 allowing for the release of fluid stored in the chamber 41 into the container.

A protective cover 50, referred to generically herein as a disenabling means, is provided over the seat 47 denying access to the restraining means when closed. The cover 50 may be hinged to the housing 40 on one side and spot tacked at points opposite to the hinge, which act as an indicator of tampering; that is, when the tacks have been ruptured one can expect that the cover 50 has been opened, restraining means lifted, and fluid released.

A disadvantage associated with this embodiment is that the fluid may be released from the closure while the closure is not sealingly engaged with a container. Notably, with the embodiments shown in FIGS. 2, 3, 5 and 6, this is not easily possible.

Figure 5:
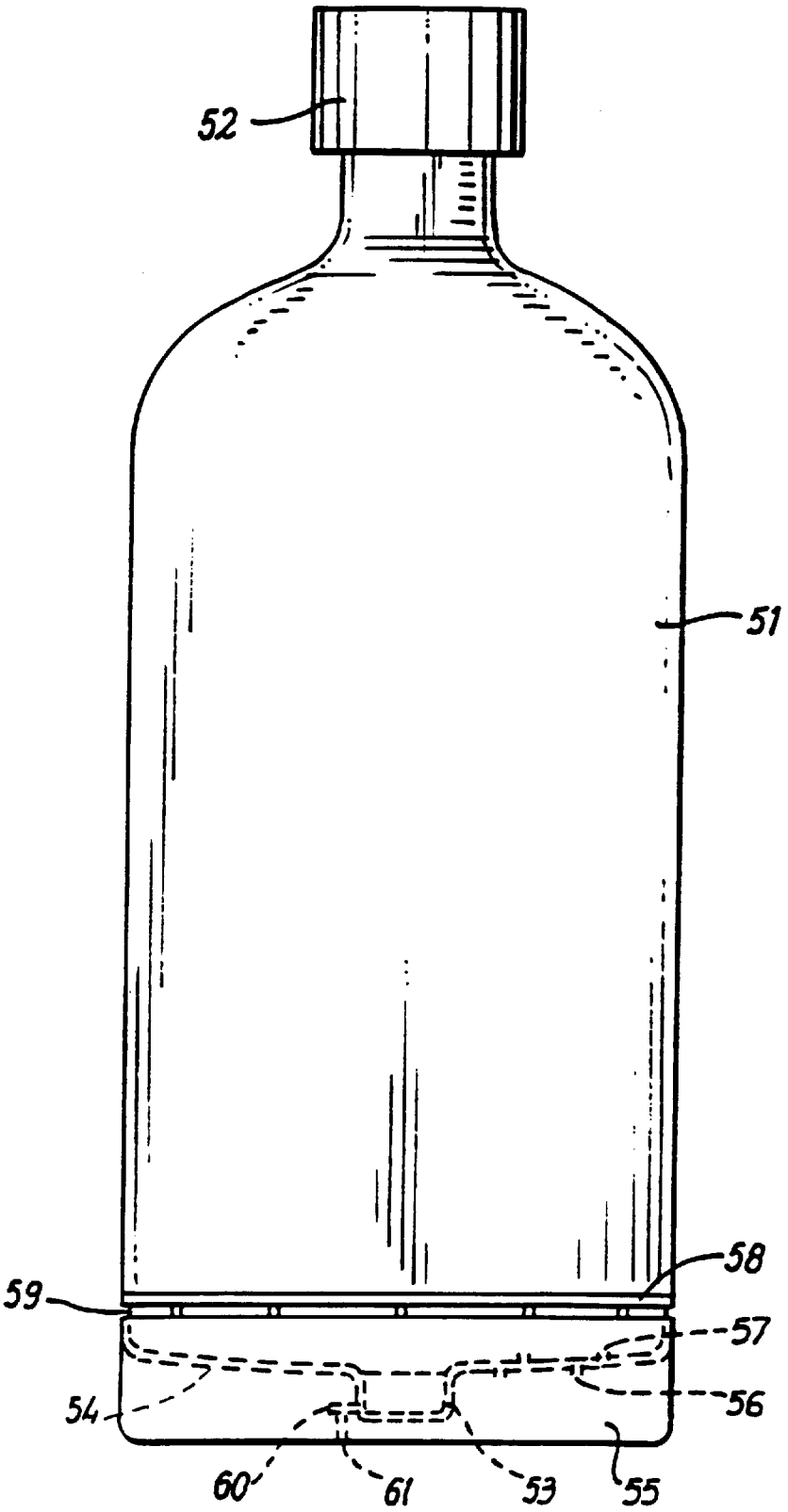
FIG. 5 shows a closure located on the bottom of a bottle and being additional to a standard bottle closure at the top of the bottle.

Although in the previous embodiments the closures are intended for attachment to the top of a container, the invention is not so limited. In FIG. 5 there is illustrated a 1.5 liter bottle 51 of carbonated soft drink bearing a standard or conventional bottle closure 52 at its upper end. The bottle 51 is however provided with a further closure attachment 53, at its lower end to which there is attached a closure 54 in accordance with the invention.

The closure again provides a sealed chamber 55 with one or more apertures 56 at its upper side. In the base of the bottle are corresponding apertures 57, although these are not aligned with the apertures 56 in the closure 54. A retaining ring 58 is fixed around the circumferential wall of the bottle and a plurality of small fractural members 59 prevent rotation of the closure 54 relative to the bottle 51 up to a predetermined minimum torque applied to the closure 54 relative to the bottle 51. In the event that this minimum torque is exceeded the closure 54 rotates about the further closure attachment 53 until it is stopped by the stopper lugs 60,61, at which point the respective apertures 56,57 in the base of the bottle 51 and the upper side of the closure 54 are aligned, allowing the flow of pressurised gas or other fluid in the chamber to disperse in the beverage.

Figure 6:
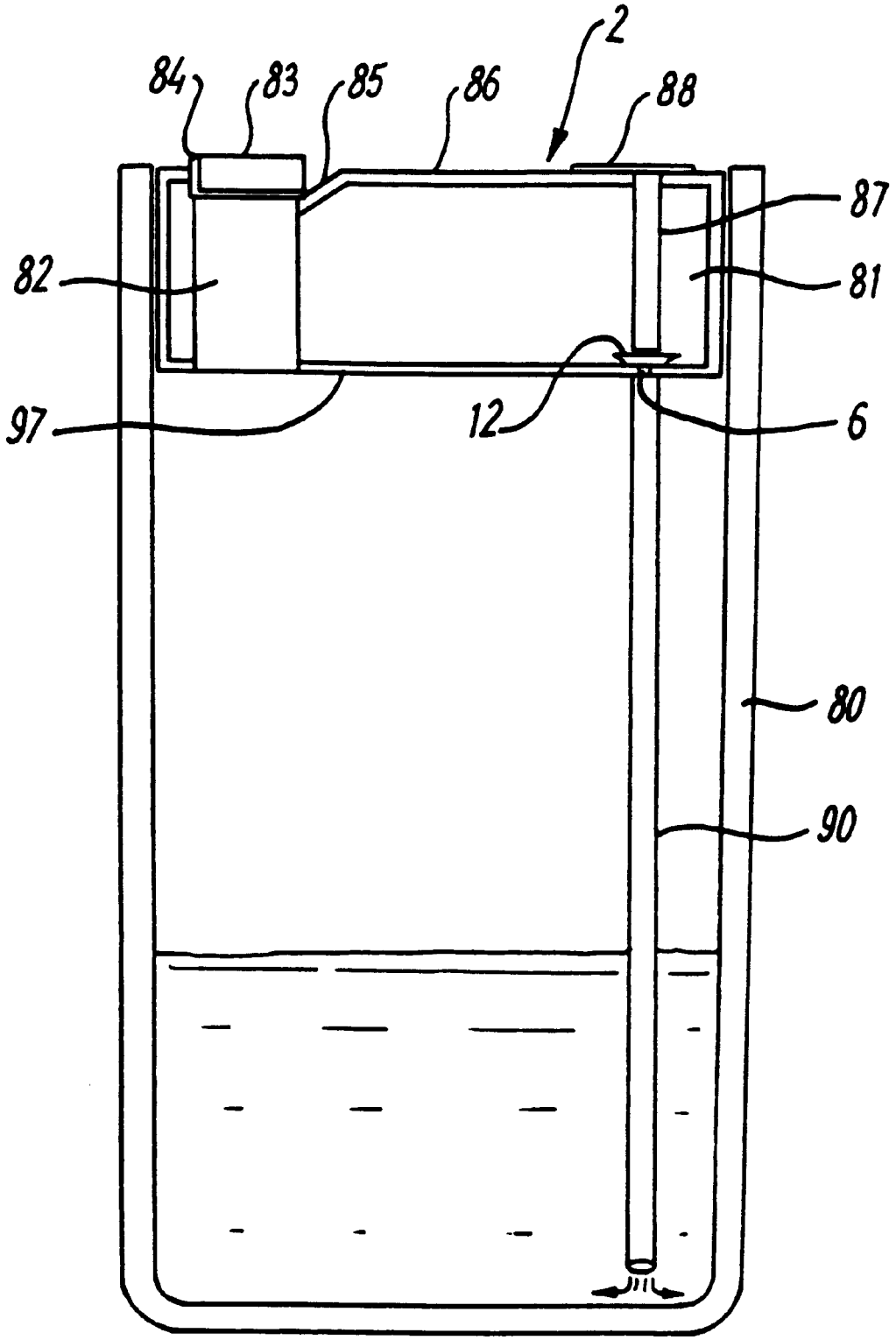

A yet further embodiment is shown is FIG. 6 wherein a container closure 202 is fitted internally in the neck of a container 80. The container 80 may be of any shape but in one embodiment it may be a plastics PET bottle formed with an open neck, the neck being of approximately the same diameter as the body of the bottle. This allows for an increased volume of fluid to be stored in chamber 81 integral with the closure 2.

The closure 202 is provided with a pouring channel 82 which is sealed at its top end by a reclosable sealing lid 83. The lid 83 is hinged at one side (by the hinge 84) and is accessed by a user's thumb or the like via the recess 85 formed in the uppermost face 86 of the closure 202.

The pouring channel 82 is separate from the chamber 81 and any fluid held in the chamber 81 may not access the pouring channel 82, while any fluid or beverage contained in the container 80 and pouring channel 82 may not access the chamber 81.

The channel 82 enables beverage contained in the container 80 to be poured from the container 80 without removal of the closure 202 from the container 80. This is in accordance with the spirit of the invention in that the integrity of the seal between the closure 202 and the container 80 is not diminished by the frequent removal and reattachment of the closure 202 to the container 80, mitigating the release of carbon dioxide from a carbonated beverage in the container.

Formed into the lower side 97 of the closure 202 is provided an aperture 6 for the release of fluid from the chamber 81 into a beverage contained in the container 80. The aperture 6 communicates with a conduit 90, which is provided with a nozzle or is otherwise so formed at its bottom end as to provide a fine spray of fluid to enhance the mixing of the fluid with the beverage when desired. A valve seal 12 is positioned over the aperture 6 and held in a closed position by the pressure of the fluid in the chamber 81. That is, the pressure of the fluid, which may be maintained at, say, 4–6 atmospheres, bears downwardly on the upper surface of the valve seal 12 to hold it in sealing engagement over the aperture 6.

Positioned directly over the valve seal 12 is a rigid conduit 87 which is attached to the upper surface 86 of the closure 202. The conduit 87, being hollow, is sealed from atmosphere at its top end by a ring pull 88. When the valve seal 12 is sealingly engaged over the aperture 6 a very small gap exists between the top surface of the valve seal 12 and the lower end of the conduit 87.

In order to open the valve 12 the ring pull 88 is removed or opened from the top surface 86 of the closure 202 allowing for the escape of pressurised fluid, preferably gas, through the conduit 87 out of the aperture formed by the opened ring pull 88. By this, relative suction forces are created which act on the upper surface of the valve seal 12 from the lower edge of the conduit 87 and these cause the valve seal 12 to lift from the aperture 6 and bear against the lower edge of the conduit 87, this action sealing the conduit 87 and opening the escape path of the gas via the aperture 6 and conduit 90 into the internal volume of the container 80.

The embodiment is most suitable for the release of a pressurised gas held in the chamber 81 into a beverage contained in the container 80.

Although not previously recommended, the conduit 90 shown in FIG. 6 is suitable in this embodiment as it is not necessary to lift the closure 202, with the conduit 90, out of the container neck every time it is desired to pour beverage from the container 80. Thus the conduit 90 will not drip or spill, nor will it render accessing the beverage awkward.

With the embodiments shown in FIGS. 5 and 6 it is not needed to invert the bottle prior to releasing the fluid in the chamber 55,81 into the container 51,80 in order to release the fluid into direct contact with the beverage.

An advantage associated with the embodiments described herein is that the holes or apertures through which the fluid passes into contact with the beverage may be preformed under manufacturing conditions. That is, the apertures are not so formed by the rupture or fracture of an element in use. While the use of preformed apertures may not be essential to the invention it does provide for enabling better dispersion or control of the flow of the fluid from the chamber into the container. This is particularly desirable where the fluid is a gas which is required to be absorbed into the liquid beverage.

Figure 7:
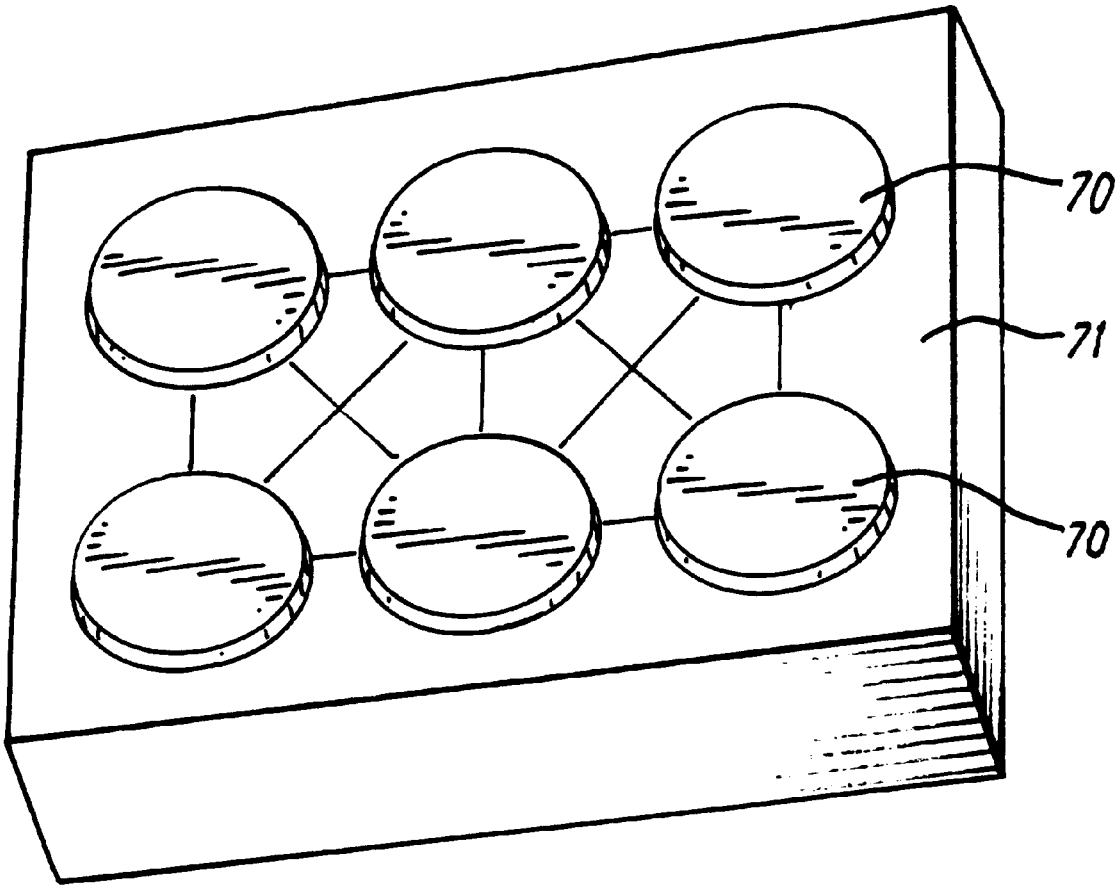
FIG. 7 illustrates a commercially packaged set of closures as may be sold to the consumer market.

In FIG. 7 a set or plurality of closures 70 are shown held in a single package 71. The illustration supports the commercial possibility of the invention allowing for closures to be retailed separately from containers, bottles or the like containing beverage. The closures 70 in FIG. 6 may be constructed in accordance with one or more of the embodiments described hereinbefore and may contain, by way of example, a syrup or flavouring in liquid form together with carbon dioxide. In use a closure can be attached to a bottle at a consumer's home, the bottle containing, for example, merely tap water prior to being mixed with the contents of the closure. Consequently the relatively awkward transporting of bulky drinks bottles from retail outlets to the home can be minimised.

Further modifications and improvements may be incorporated without departing from the scope of the invention herein intended.

What is claimed is:

1. A closure for use in relation to a beverage container, the closure comprising sealing means for sealingly engaging the container, an integral chamber formed within or as part of the closure for sealingly containing a fluid for mixture with the beverage, and a release means for releasing the fluid from the chamber to the attached container, wherein the sealing means enables the closure to be repeatedly and sealingly attached to and removed from the container without essentially operating the release means, wherein the release means includes one or more apertures or ports in a wall of the chamber, the one or more apertures or ports being associated with a valve that is resealable on the aperture after having been opened such that when the closure is engaged with the container and the valve is open the fluid in the chamber may physically communicate with the beverage and when the valve is closed the fluid is retained in the chamber, and wherein the valve is operable to an open position only when the closure is attached to the container and is necessarily returned to a closed position upon or prior to being removed from the container.

2. A closure as claimed in claim 1, wherein the chamber is constructed as a pressure vessel to safely house a carbonating fluid pressurized in excess of twenty atmospheres.

3. A closure as claimed in claim 1, wherein the one or more apertures or ports is or are preformed in the chamber wall.

4. A closure as claimed in claim 1 wherein the one or more apertures or ports is or are formed or associated with a nozzle designed to release a gaseous fluid into the beverage in the form of a fine spray of bubbles.

5. A closure as claimed in claim 1 further comprising a retaining means releasable by the tightening or clockwise rotation beyond a predetermined level of the closure or part of the closure on or relative to the container, wherein the valve includes a valve seal retained by the retaining means in a sealing relationship with the one or more apertures or ports when the valve is closed.

6. A closure as claimed in claim 1, wherein the valve includes a valve seal retained in a sealing relationship with the aperture when the valve is closed by a retaining means comprising fluid pressure acting on the valve seal, the retaining means being releasable by reversing the fluid pressure gradient across the valve seal so as to encourage it to move in a direction away from the aperture.

7. A closure as claimed in claim 1, wherein the valve may be operable to an open position only when the closure is in an inverted orientation.

8. A closure as claimed in claim 1, further provided or inherent with valve disenabling means for preventing the inadvertent opening of the valve, the disenabling means being in the form of an insert located in the closure which may be removed or disengaged, when intended, at the discretion of the user.

9. A closure as claimed in claim 1 further provided or inherent with valve disenabling means for preventing the inadvertent opening of the valve, the disenabling means being in the form of one or more associated lugs or catches which require to be fractured or pressed past in order to open the valve.

10. A closure as claimed in claim 1 further provided or inherent with valve disenabling means for preventing the inadvertent opening of the valve, the disenabling means being a cover denying access to the retaining means during the usual opening or closing operation of the closure relative to the container.

11. A closure as claimed in claim 1, wherein the chamber houses a fluid comprising a gas of a type which is soluble in the beverage and when so dissolved has the effect of increasing the carbonation of the beverage.

12. A closure as claimed in claim 1, where the gas is carbon dioxide.

13. A closure as claimed in claim 1 wherein the fluid includes a refrigerant.

14. A closure as claimed in claim 1, wherein the fluid includes a flavoring.

* * * * *

UNITED STATES PATENT AND TRADEMARK OFFICE
CERTIFICATE OF CORRECTION

PATENT NO : 6,076,570

DATED : June 20, 2000

INVENTOR(S) : Paul Anthony Byrne

It is certified that error appears in the above-identified patent and that said Letters Patent are hereby corrected as shown below:

In block 57 of the title page, line 3, please change "court" to --port--.

In column 4, line 16, please change "plastics" to --plastic--.

In column 9, line 28, please change "drinks" to --drink--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*